United States Patent [19]

Pearman et al.

[11] Patent Number: 4,545,583

[45] Date of Patent: Oct. 8, 1985

[54] ELECTRONIC GUN AND TARGET APPARATUS AND METHOD

[75] Inventors: Bruce W. Pearman; Clark Pelton; Todd K. Roper; Layne C. Tivis, all of Colorado Springs, Colo.

[73] Assignee: Showdown Electronics, Inc., Colorado Springs, Colo.

[21] Appl. No.: 452,814

[22] Filed: Dec. 23, 1982

[51] Int. Cl.[4] ..... F41G 3/26

[52] U.S. Cl. ..... 273/311; 434/22

[58] Field of Search ..... 434/21, 22; 273/1 E, 273/1 GC, 181 H, 310–316

[56] References Cited

U.S. PATENT DOCUMENTS

| | | | |
|---|---|---|---|
| 3,104,478 | 9/1963 | Strauss et al. | 434/22 |
| 3,898,747 | 6/1974 | Marshall | 434/22 |
| 4,352,665 | 10/1982 | Kimble et al. | 434/22 |

*Primary Examiner*—Richard C. Pinkham
*Assistant Examiner*—MaryAnn Stoll Lastova
*Attorney, Agent, or Firm*—Young & Martin

[57] ABSTRACT

A simulated fire and hit indicator apparatus and method includes two opponent stations having a gun device and a target device and a master control unit. Each gun device generates a dispersed trigger-active signal and a focused bullet signal; preferably in the form of a modulated pulse burst powering infrared emitters. Detectors, preferably in the form of phototransistors, are mounted in each target to sense the bullet signals and each operates to produce a hit signal when struck by an opponent's bullet signal. The trigger-active signals are detected, again preferably by phototransistors, and produce fire signals corresponding to respective gun devices. Each station includes processing circuitry to produce uniform pulse bursts representative of the fire and hit signals of the station, and the signals may be mixed and may be used to enable a radio transmitter that broadcasts the fire and hit data to a receiver on the master control. The master control includes decoding circuits to separate the data into component signals corresponding to the fire and hit status of each station. The master control outputs all fire data, but includes logic circuits that prohibit output of a later received hit signal and implements output for an earlier received hit signal. Accordingly, the method comprises the production and processing of these various signals.

31 Claims, 12 Drawing Figures

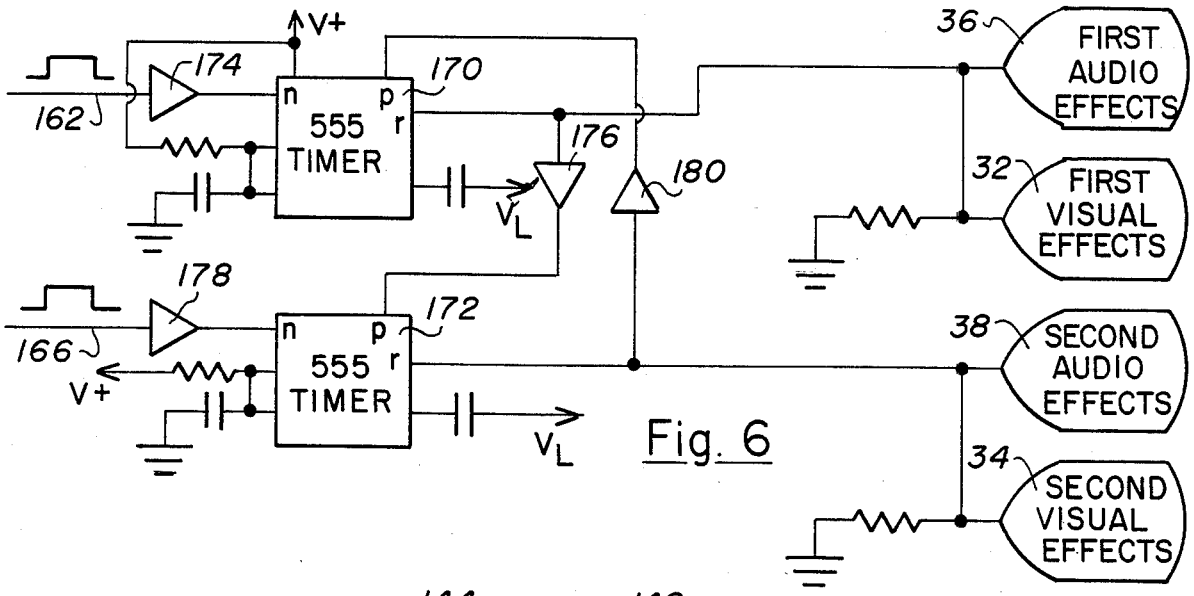
Fig. 6
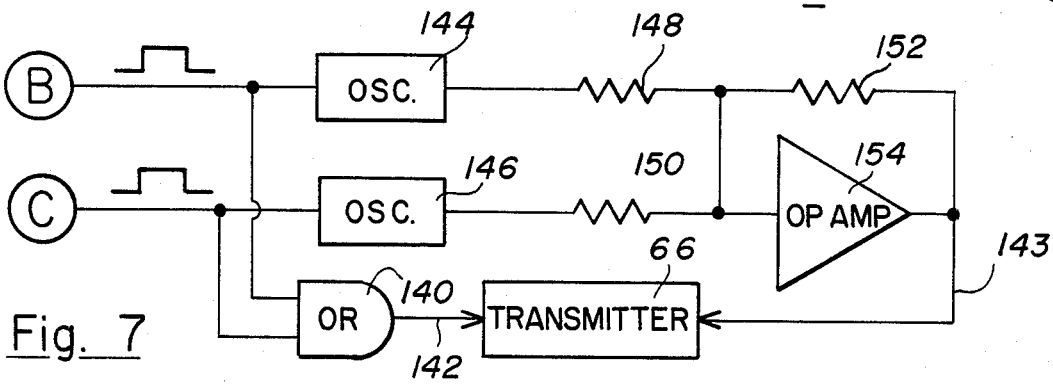
Fig. 7
Fig. 8a TIMER AND MULTIVIBRATOR PULSE
Fig. 8b OSCILATOR AND DRIVER
Fig. 8c FREQUENCY DIVIDER
Fig. 8d PHASE LOCKED LOOP
Fig. 8e PULSE PROCESSOR AND STRETCHER
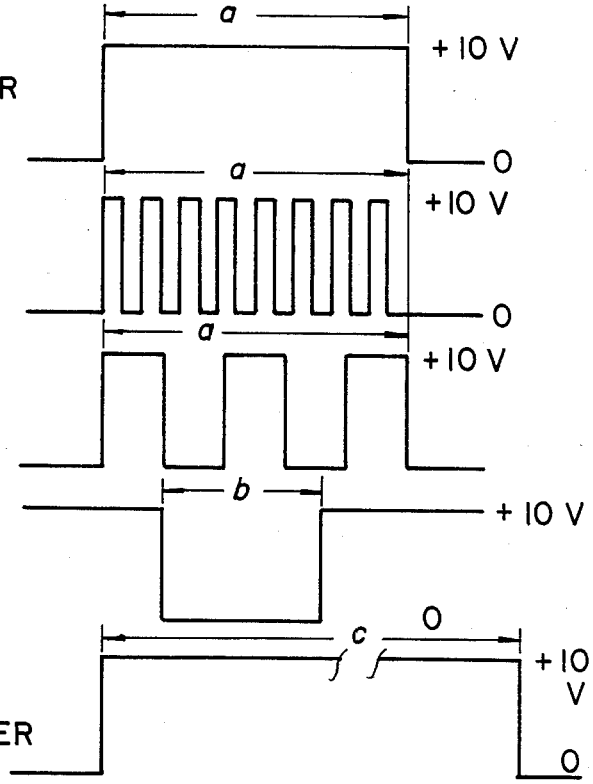

ELECTRONIC GUN AND TARGET APPARATUS AND METHOD

BACKGROUND OF THE INVENTION

The present invention relates to an electronic gun and target apparatus wherein a gun device emits a signal simulating a bullet which signal may be detected by a target so that a hit may be registered. More specifically, the present invention relates to an electronic gun fight game wherein two players simulate a gun fight. To this end, each player is equipped with a gun device and each wears a target. The players may then "face off" in a gun duel with each player firing a simulated bullet at one another.

In the past, simulated gun and target devices have been developed wherein a player fires a simulated bullet that is detected by a target. Many electronic amusement devices, such as arcade games, utilize a simulated weapon and target system wherein the weapon fires a simulated bullet in the form of a transmitted signal which bullet may be received by the target to score a hit. The present invention, however, is directed to a gun and target device wherein the players actually wear a target and are each equipped with a gun with the players then firing at each other's targets. Such systems, wherein two players interrelate with one another are shown among the prior art but are not provided with the advantages and features found in this invention.

For example, U.S. Pat. No. 3,294,401 issued Dec. 27, 1966 to Nicholas et al discloses an electronic target game wherein each player is provided with a helmet and a light ray gun. Each helmet includes a target, and each gun fires a simulated bullet from a gas discharge tube, which bullet may be aimed at the opposing player's helmet. When the simulated bullet strikes the target, the helmet is activated to register a hit. French Pat. No. 2,326,675 issued Oct. 1, 1975 to Alexandre discloses a gun and target apparatus that allows the two players to simulate a pistol duel. Each player stands on a movable conveyor belt, and, when a player's target is struck by a simulated bullet in the form of a light beam from the opposing player, the conveyor belt corresponding to the hit player moves, thereby causing the player to loose his balance and fall. French Pat. No. 2,426,497 issued May 22, 1978 to Grandval discloses an electronic dueling system wherein imitation pistols are used to fire at an opponent. Each player or opponent has a target mounted on his body, and each player may have a shield which may reflect or block the simulated bullet fired by the opponent player. Hits on one player are electronically scored by the apparatus.

A more sophisticated hit-indicator system is shown is U.S. Pat. No. 3,434,226 issued Mar. 25, 1969 to Schaller. In the Schaller patent, the activation by a first opponent of his gun causes an omnidirectional interrogation signal to be transmitted toward a second opponent. When this signal is detected by a target apparatus worn by the second opponent player, the target radiates an infrared pulse. The rifle of the first opponent may then sense this infrared signal emitted by the target, and, in response to its receipt, emits or produces an electrical output signal which allows the hit to be scored either by the opponent firing the bullet signal, the opponent hit by the bullet signal, or by both opponents.

Even though these prior art systems disclosed simulated fire and hit indicator systems, none provides the degree portability and flexibility sufficient to produce a realistic simulated gun fight between two players. Further, none of these systems disclose the production of a plurality of bullet, hit and trigger signals that are processed to produce realistic outputs of firing yet which include circuitry that interlocks hit signals to register a unique hit.

SUMMARY OF THE INVENTION

It is therefore an object of the invention to provide a novel and useful fire and hit indicator apparatus that allows a user to fire a simulated bullet at a target which firing and hitting operation may be registered in a novel fashion.

Another object of the present invention is to provide a simulated fire and hit indicator apparatus wherein two or more opponents may realistically simulate a gun fight.

It is a further object of the present invention to provide a simulated fire and hit game apparatus wherein the apparatus generates output corresponding to and indicative of the activation status of the players' firing devices whereas the apparatus only registers output indicative of hit data corresponding to the target that is struck by an opponent's simulated bullet first in real time.

It is still a further object of the present invention to provide a simulated firing device that generates a pair of encoded output signals such that one signal indicates the firing of the apparatus while the other signal provides a simulated bullet with both of these signals being used by master control circuitry to generate output corresponding to the fire and hit status of the gun and a target.

It is still a further object of the present invention to provide a highly portable simulated fire and hit indicator apparatus that realistically simulates a gun fight without requiring wiring interconnecting the various guns, targets, and control circuitry.

To accomplish these objects, the present invention includes at least one firing device that emits a bullet signal and trigger-active signal, at least one target device responsive to the bullet signal to generate a hit signal, and control and processing circuitry responsive to the trigger-active signal and the hit signal to simulate firing and hitting operations. More particularly, the present invention preferably has at least two stations, with each station having a firing device in the form of a gun, a target device including bullet signal sensors, a trigger-active signal sensor, and associated electronics corresponding to the two signal sensors. Interface circuitry is provided to process the data from the four potential signals generated by the two stations. In operation, the gun of a first station is fired towards the target device of the second station, and the gun of the second station is fired toward the target device of the first station.

Each firing device, then, includes a trigger having an electronic switch such that, upon activation of the switch, the firing device emits two separate signals, preferably in the form of a modulated pulse of infrared light. Of these, a bullet signal is focused in a relatively tight beam so that it may be aimed at an opponent's target. The second or trigger-active signal is a widely dispersed beam of infrared light that is also a modulated pulse having a frequency different from that of the bullet signal. Each target includes a sensor, such a phototransistor that is sensitive to the wavelength of the infrared bullet signal. Each sensor is connected to associated electronics such that, when the phototransistor receives the bullet signal, the target generates a hit signal corresponding to receipt of the bullet signal. Similarly, when the sensor associated with the trigger-active signal receives the trigger-active signal, its associated electronics generates a fire signal indicating that the trigger has been pulled on its associated firing device. These two signals are data carrying signals that may be mixed together in an encoding circuit so that they may be transmitted to a master control module having control circuitry. In the preferred embodiment of the present invention, an enabling circuit turns on the transmitter only when one of the fire or hit signals is present, and this transmission occurs over a radio frequency transmitter, with the master control having a pair radio receiver, one receiver tuned to an associated transmitter at one of the stations.

The master control circuitry generates output upon receipt of the fire and hit data contained in the encoded signals, an important feature of the present invention resides in the use of a latching circuit in the master control that selectively passes or prohibits the generation of output corresponding to these signals. More specifically, the master control includes decoding circuitry that separates each of the transmitted signals into components such that there are four components for a two-station system. Two of these components correspond to the trigger-active or fire signals and the remaining two correspond to hit signals. The master control includes circuitry that always passes the fire signals so that output is generated at any time a trigger switch becomes active. With respect to the two hit signals received by the master control, however, the master control only passes the hit signal that is first received in real time. Output of a hit condition, then, is only generated by the master control for the station that is first hit by the other station's firing device or bullet signal. Output from the master control can either be displayed in a audio format or in a visible format as is known in the art.

In order to distinguish between a trigger-active and a bullet signal, the present invention includes circuitry elements that modulate the bullet signal and the trigger-active signal at different frequencies. A multivibrator may also be provided in the electronics associated with the firing device such that a pulse burst of a selected duration is generated to form the basis for each bullet and trigger signal. Also, the electronics associated with the target and with the trigger sensors may be provided with a pulse stretcher circuitry so that receipt by the sensors of any portion of the bullet signal or the trigger signal results in the generation of a uniform pulse burst of selected duration indicating a fire and/or hit condition so that uniform fire and hit signals are transmitted to the master control.

The method according to the preferred embodiment of the present invention broadly includes the steps of generating a first trigger-active signal and a first bullet signal at the first source and a second trigger-active signal and a second bullet signal at a second source. The method includes a second step of generating a hit signal whenever a target device is activated by being struck by a bullet signal. Output is produced in response to each generated trigger-active signal, and output is produced which output indicates the presence of a hit signal generated by the targer device that is first activated while output corresponding to a later activated target device is prohibited. In greater detail, the method also includes producing the bullet signals and trigger-active signals as pulse bursts, and modulating the trigger-active and bullet signals, preferably at different frequencies. The method also contemplates producing a uniform fire signal from each trigger-active signal regardless of the period that the trigger-active signal is detected, and the method includes producing a uniform hit signal regardless of the period that the bullet signal is detected. In both cases, though, it is understood that detection of each signal must last for at least a minimum selected threshhold duration.

These and other objects, advantages, and features of the present invention will become more readily appreciated and understood when taken together with the following detailed description in conjunction with the accompanying drawings, in which:

BRIEF DESCRIPTION OF THE DRAWINGS

FIG. 6 is a block diagram of the master control latching circuit according to the preferred embodiment of the present invention;

FIG. 7 is a diagram of the encoder/enabler circuit of the present invention; and FIGS. 8A–8E are graphic representations of various voltage pulse bursts that occur at various points in the circuitry of the present invention.

DETAILED DESCRIPTION OF THE PREFERRED EMBODIMENT

The present invention is directed to a simulated fire and hit indicator apparatus which may be used as a target practicing system, or, more preferably, as an gun fight game wherein two opponents engage each other in a mock battle or "fast draw" gun fight. To this end, the present invention includes at least one firing device or gun, at least one target device, and control electronics to process fire and hit data according to the state of the firing device and the target device. The master control circuitry then generates output indicating a mock fire and/or hit corresponding to the state of each fire and target devices. More preferably, the game includes at least two firing devices, each of which is capable of generating a pair of signals, and at least two target devices responsive to the various signals generated by the firing devices. In this manner, the apparatus allows at least two opponents to face one another in a mock battle such as the gun fight shown in FIG. 1.

Figure 1:
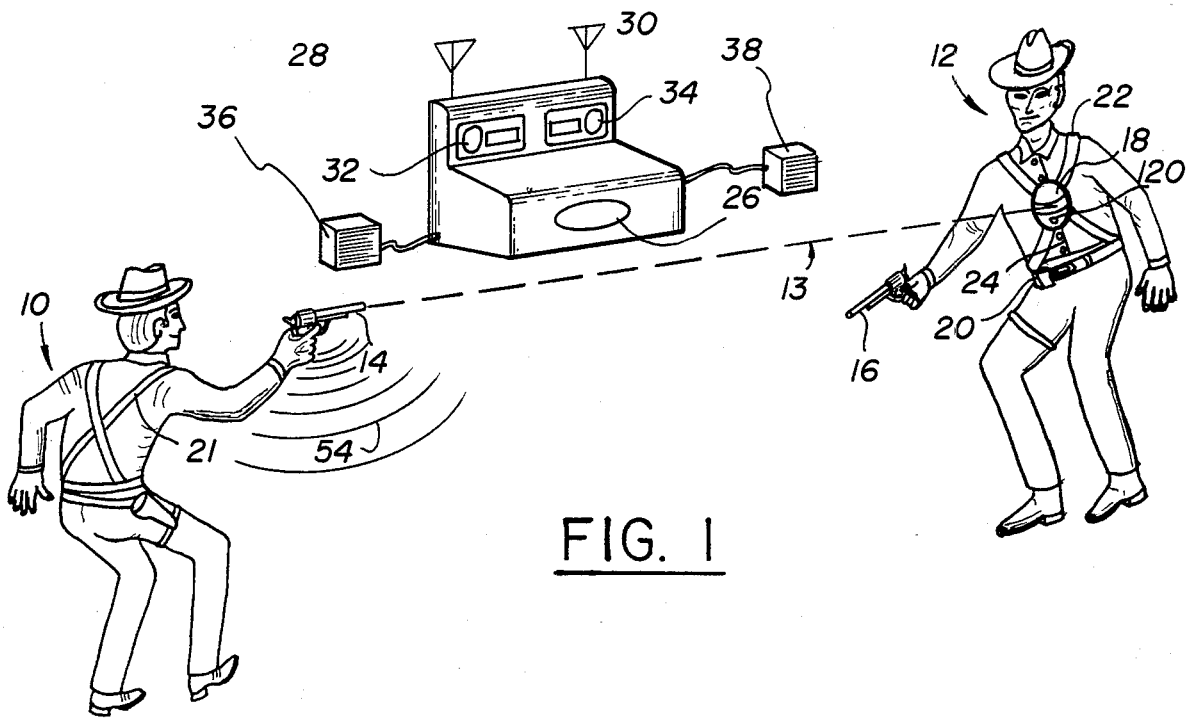
FIG. 1 is a pictorial view of opponent players using the simulated fire and hit indicator apparatus according to the preferred embodiment of the present invention.

Specifically, as is shown in FIG. 1, a first opponent 10 is engaged in a mock gun duel with a second opponent 12. First opponent 10 has a firing device or gun 14 that may emit a bullet signal 13 directed towards a target device 18 mounted by straps 22 to second opponent 12. Second opponent 12 has belt electronics module 20 also secured by straps 22 and which is electrically connected to target 18 by means of a wire 24. Second opponent 12 has a firing device or gun 16 which, in FIG. 1, has not been fired. While not shown in FIG. 1, but represented in FIG. 2, first opponent 10 has a target device 17 mounted by straps 21 and a belt electronics module 19 also mounted by straps 21 and connected to target 17 by a wire (not shown) similar to wire 24. A master control unit 26 has a pair of antennae 28 and 30 and has dual audio and dual visual output displays, such as visual outputs 32 and 34 and audio outputs in the form of speakers 36 and 38. It should be appreciated that it is the intent of first opponent 10 to direct first gun 14 so that it emits a signal 13 aimed at target 18, while second opponent 12 fires second gun 16 in order to emit a signal 15 aimed at first target 17.

Figure 2:
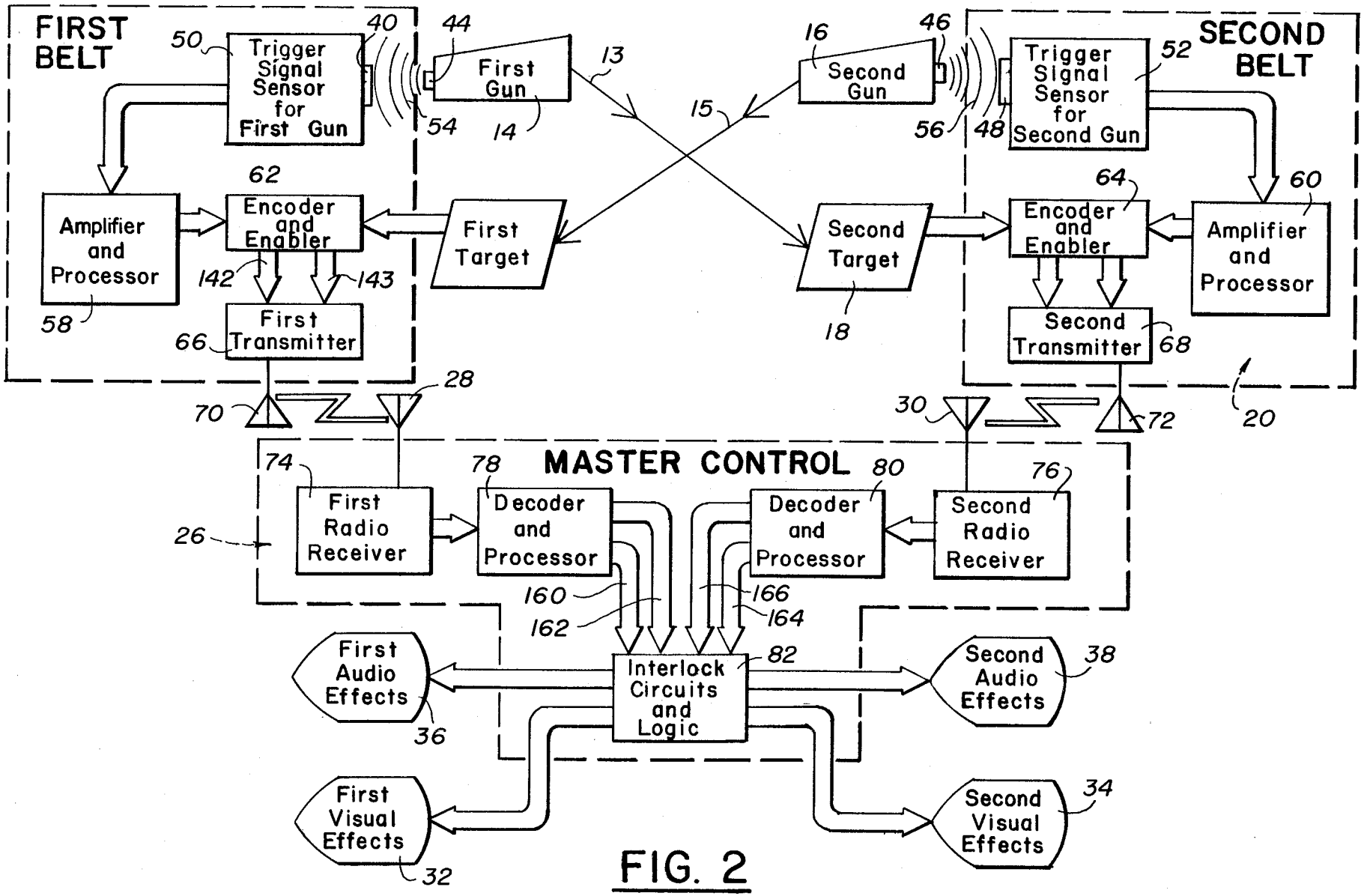
FIG. 2 is a block diagram showing the simulated fire and hit indicator apparatus according to the preferred embodiment of the present invention.

Turning to the diagram shown in FIG. 2, it should be appreciated that the present invention is particularly adaptable to be a two-opponent or two-station system broadly including first and second firing devices in the form of first and second guns 14 and 16, first and second targets 17 and 18 which are respectively constructed to be responsive to signals 15 and 13 and associated control and processing electronics. First electronic module 19 includes a trigger-signal sensor 50 including a sensor element 40 adapted to receive a trigger-active signal 54 from the first gun emitter 44 and to respond to the receipt of signal 54 by generating a fire signal which is introduced to an amplifier and processor 58. Amplifier and processor 58 produces an enhanced fire signal which is then introduced to an encoder and enabler 62.

A similar system is shown with respect to electronic module 20 wherein a second trigger-active signal 56 corresponding to the activation of the trigger of a second gun 16 is emitted from emitter 46. The trigger-active signal 56 is detected by signal sensor 48 of sensor 52 which then generates a fire signal. The fire signal is introduced to amplifier and processor 60 which in turn presents a an enhanced signal to encoder and enabler 64.

Data corresponding to a "hit" or target-active state is also processed by electronic modules 19 and 20 for their respective stations. With respect to electronic module 19, when first target 17 receives bullet signal 15 from second gun 16, it generates a hit signal that is presented to encoder and enabler 62 which then encodes the hit signal. Likewise, when second target 18 is struck by bullet signal 13, second target 18 generates a second hit signal which is presented to encoder and enabler 64.

Encoder and enabler 62 and encoder and enabler 64 each perform two functions. First, the encoder and enablers 62 and 64 each activate respective radio transmitters 66 and 68 when either a fire signal or a hit signal is present. Second, they each receive respective fire and hit signals and generate a single combined or mixed signal that encompasses both fire and hit data. Encoder and enabler 62 then passes its combined signal to a radio transmitter 66 that preferably operates on the FM band. Similarly, encoder and enabler 64 passes its combined signal to a radio transmitter 68 which also preferably operates on the FM band, but at a carrier wave frequency that is different from transmitter 66. Each of the radio transmitters 66 and 68 have an antenna, such as antenna 70 and antenna 72 connected to transmitters 66 and 68, respectively.

A master control circuitry diagram is shown in FIG. 2 where it should be appreciated that two radio receivers are provided to receive the signals from radio transmitters 66 and 68. First radio receiver 74 has an antenna 28 and operates to receive signals from transmitter 66, and a second radio receiver 76 has an antenna 30 and operates to receive signals from transmitter 68. The signals are then passed to decoders and processors 78 and 80 respectively, each of which separates the combined signals transmitted by its radio transmitter 66 or 68. Each decoder and processor 79, 80 separates its respective combined signal into two component signals, a fire component signal and a hit component signal. Thus, four component signals 160, 162, 164 and 166 are generated with these four components being introduced into logic and interlock circuitry 82. Logic and interlock circuitry 82 performs as discrimination circuitry and processes the component signals to generate audio effects and first visual effects for each of opponents 10 and 12. Logic and interlock circuitry 82 produces first visual effects at visual display 32 and first audio effects at speaker 36, all of which correspond to opponent 10. Similarly, logic and interlock circuitry 82 produces second audio effects and second visual effects at speaker 38 and display 34, respectively, which correspond to second opponent 12.

Figure 3:
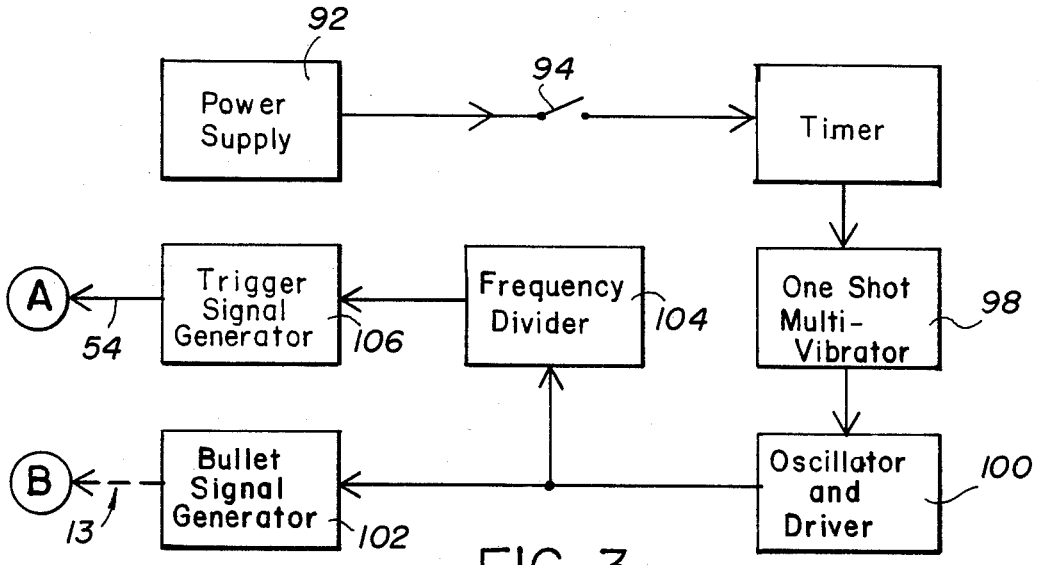
FIG. 3 is a block diagram of a firing device shown according to the preferred embodiment of the present invention.
Figure 5:
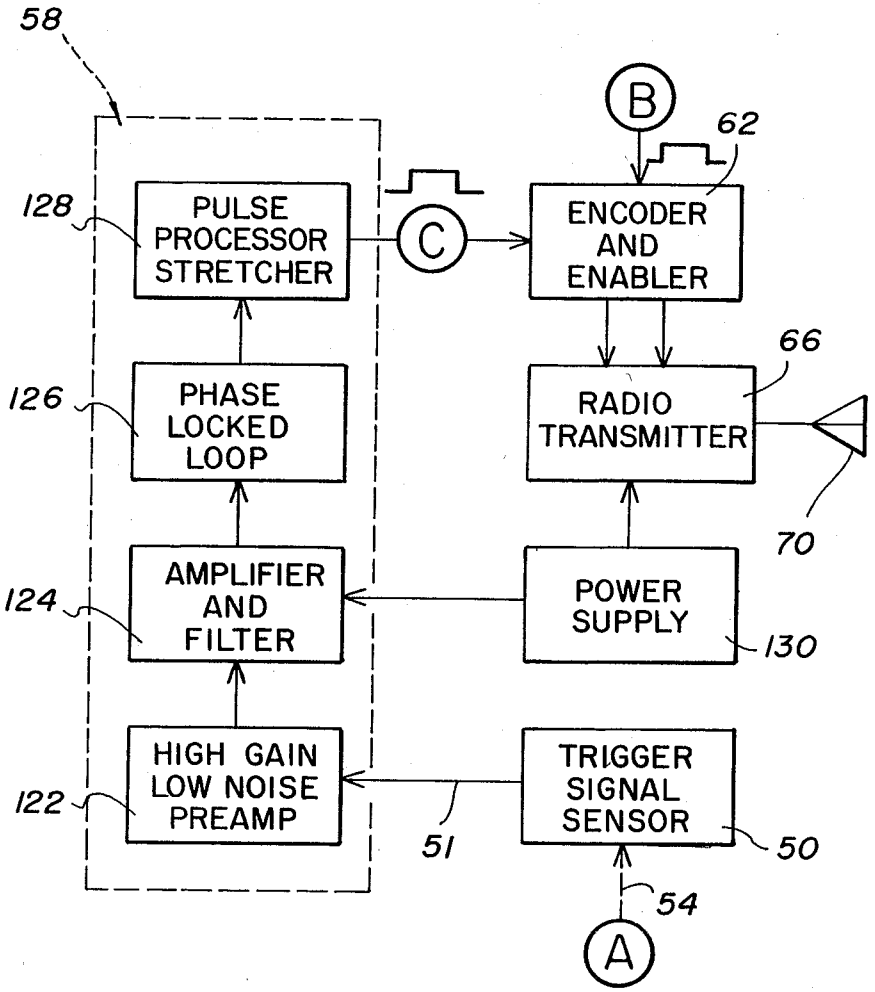
FIG. 5 is a block diagram of the electronics associated with a firing device and a target device according to the preferred embodiment of the present invention.
Figure 4:
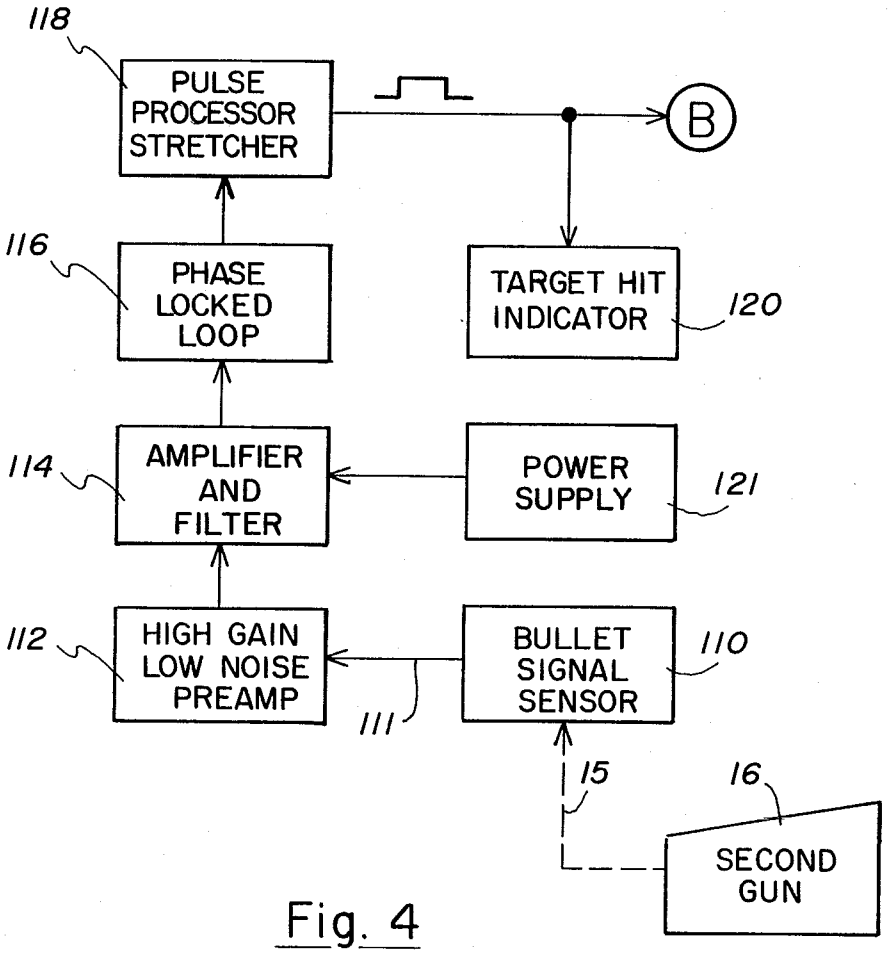
FIG. 4 is a block diagram of a target device according to the preferred embodiment of the present invention.

While the above description broadly sets forth the various components of the present invention, these components are shown in greater detail in subsequent figures. For example, FIG. 3 shows a diagram of firing device or gun 14, and it should be appreciated that the construction of gun 16 is the same as FIG. 3. FIG. 4 shows a diagram of the electronics for target device 17, and, again, second target 18 is identical. FIG. 5 shows a diagram of the "belt electronics" for the electronic module 19, and, again, electronic module 20 is the same. FIG. 6 shows in greater detail a diagram of the electronics corresponding to the circuitry of logic and interlock circuitry 82, and FIG. 7 shows the circuitry of the encoder and enablers 62 and 64.

Turning to the diagram shown in FIG. 3, it should be appreciated that the firing device shown in FIG. 3 is operative to produce two separate signals designated as bullet signal 13 and trigger-active signal 54. Gun 14 shown in FIG. 3 has activation circuitry which includes a power supply 92 which is operated by means of a switch 94 which, in the preferred form of the present invention, is connected to and operated by a trigger on first gun 14. When switch 94 is closed, the circuit is active, and when swtich 94 is open, the firing device circuit is inoperative. Power supply 92 is connected through switch 94 to a one-shot multivibrator 98, and an oscillator and driver 100. When power is supplied to multivibrator 98, a voltage burst is generated, and the voltage burst is presented to oscillator and driver 100 wherein the voltage burst is modulated at a preselected frequency. As is shown in FIG. 8A, this voltage burst lasts for a duration "a" during which the output voltage of the multivibrator is raised from 0 volts to 10 volts. Preferably, the duration "a" is selected to be approximately 25 milliseconds. This generally square wave pulse is then presented to oscillator and driver 100 which, as is shown in FIG. 8B, modules the square wave for the entire duration "a." In the preferred embodiment, this modulation is at approximately 10,000 Hz, with a peak-to-peak voltage change of +10 volts to 0 volts. This modulated pulse is then presented to bullet signal generator 102, which, in the preferred form of the present invention, is an infrared light source that can be focused into a tight beam. Thus, the bullet light source is turned on and off at the frequency of oscillator and driver 100 for a duration of time "a."

The modulated pulse of energy from oscillator and driver 100 is also provided to a frequency divider 104 which changes the frequency of the modulation on this pulse with the altered frequency pulse then being presented to a trigger-signal generator 106 which, in FIG. 1, is emitter 44. As is shown in FIG. 8C, frequency divider 104 changes the frequency of the pulse burst to be different than that of FIG. 8B, but still lasts for a duration "a" and has a peak-to-peak voltage difference of +10 volts to 0 volts. Preferably, frequency divider 104 divides the frequency of the modulated pulse burst by a factor of four so that the resulting modulated pulse burst has a frequency of approximately 2500 Hz. In the preferred form of the present invention, emitter 44 is a second infrared light source. Thus, emitter 44 turns on and off at a frequency of approximately 2500 Hz for a time duration "a." It should be appreciated, that, upon activation of switch 94, a pair of infrared signals are produced by gun 14 with one of these signals being a burst of limited duration as a bullet signal 13 that is modulated at one frequency, while a trigger-active signal 54 is produced as a burst of limited duration modulated at a second frequency different from the frequency of the bullet signal 13. Multivibrator 98 prevents continuous firing of firing gun 14 since multivibrator 98 must be reactivated by the opening switch 94, which corresponds to placing a 0 voltage on the input of multivibrator 98.

A diagram of the electronic circuitry for a target such as first target 17 or second target 18 is shown in FIG. 4. As can be seen in FIGS. 2 and 4, bullet signal 15 is received by target 17 from gun 16 and may be sensed by a bullet signal sensor 110 which is responsive to the type of signal 15 and, in the preferred invention, is a phototransistor. The bullet signal sensor 110 emits a hit signal 111 which is passed to a high gain, low noise amplifier 112 which then passes the signal to amplifier and filter 114 which further amplifies the hit signal and filters interference out of the hit signal. The hit signal is then passed through a phase-locked loop 116.

Phase locked loop 116 is tuned to the frequency of bullet signal 15 and responds to this frequency by generating a logic low voltage level for the duration of time that the phase-locked loop 116 is subjected to a signal that has its tuned frequency. This logic low is shown in FIG. 8D where the logic low has a duration "b" that may be less than or equal to duration "a." This logic low voltage then activates pulse processor and stretcher 118, which is preferably a one-shot multivibrator, that then generates an enhanced hit signal in the form of a uniform pulse burst, as is shown in FIG. 8E, of selected duration "c." In the preferred invention, this pulse burst has a duration of approximately one second. Thus, the pulse processor and stretcher 118 modifies the hit signal so that, if the sensed hit signal meets minimum threshold requirements, for example, 1 microsecond, pulse processor and stretcher 118 generates a hit signal that has a uniform duration and frequency regardless of the duration of the originally sensed hit signal. This uniform hit signal is then directed to the belt electronics described below, but may also be used to initiate a localized target hit indicator 120 to an immediately indicate a hit. Thus, if bullet signal sensor 110 detects a threshold bullet signal 15 at the tuned frequency of phase-locked loop 116, target hit indicator 120 is activated and a uniform hit signal is directed to further processing electronics, preferably mounted, for example, in electronic modules 19 or 20. To provide power for the target device 17, a power supply 121 is provided in the circuitry of target 17 and is connected to the amplifier and filter 114. It should be appreciated that the various components shown in FIG. 4 are all electronically connected to the power supply 121 either directly or through the amplifier and filter 114.

A more detailed diagramatic representation of the belt electronics of modules 19 and 20 is shown in FIG. 5 and is described with respect to module 19. Here, it should be apppreciated that the amplifier and processor 58 is separated into several subcomponents. Trigger-active signal 54 is detected by a sensor 50 which is matched to the type of signal 54 and which, in the preferred invention, is a phototransistor. The sensor 50 produces a fire signal 51 that is presented to a high gain low noise preamplifier 122 which amplifies the fire signal and presents the fire signal to amplifier and filter 124. The fire signal is then further amplified by amplifier and filter 124 and passed to a phase-locked loop 126 which is tuned to the frequency of trigger-active signal 54 and, correspondingly, fire signal 51. When phase-locked loop 126 detects a signal at its tuned frequency, it generates a logic low in a manner similar to phase locked-loop 116 as shown in FIG. 8D. If this logic low reaches a minimum threshhold duration, it triggers pulse processor and stretcher 128 which is preferably another multivibrator. Pulse processor and stretcher 128 operates to generate an enhanced and uniform fire signal that is of a uniform duration regardless of the duration of the original fire signal generated by trigger-signal sensor 50. This uniform fire signal preferably is a one second pulse burst that is presented to an encoder and enabler 62. A power supply 130 provides the necessary power for this system and is shown connected to amplifier and filter 124. It should be appreciated that all of the components of this system are powered by power supply 130 and are thus connected through the circuitry of amplifier and filter 124 or connected in some other way to power supply 130.

As noted, both a uniform fire signal and a uniform hit signal are presented to encoder and enabler 62. Thus, encoder and enabler 62 receives two signals, a uniform fire signal corresponding to the firing of the gun 14 associated with a particular player, such as opponent 10, and a uniform hit signal corresponding to that player's target getting "hit" by the other players's bullet signal. Naturally, second gun 16 and second target 18 are connected to a similar encoder and enabler 64 shown in FIG. 2. With respect to these, a description will be made only with respect to encoder and enabler 62 but it should be appreciated that the same operation takes place in encoder and enabler 64 as well.

Encoder and enabler 62, then, receives a uniform hit signal from the pulse processor and stretcher 118 of target 117 and a uniform fire signal from the pulse processor and stretcher 128 of belt electronics 19. These two signals are mixed to form a single modulated signal that carries data indicative of both the status of first gun 14 and the status of first target 17. Thus, this data signal may contain "no data" when gun 14 has not been fired and when first target 17 has not received a bullet signal from second gun 16. The encoder and enabler 62 may receive either a hit signal or a fire signal, and encoder and enabler 62 may receive both a fire signal and a hit signal. If either or both of these signals are present, the enabler circuitry of encoder and enabler 62 activates radio transmitter 66 so that it broadcasts a signal over antenna 70.

FIG. 7 shows a diagram of the circuitry for an encoder and enabler 62. Here, a uniform hit signal may be present at B, and/or a uniform fire signal may be present at C. An "or" gate 140 interconnects B and C so that the presence of either signal causes gate 140 to switch on transmitter 66 by producing an enabling signal on transmitter switch input 142. The fire and hit signals also pass through oscillators 144 and 146, respectively, which encode the signals as differently modulated pulse bursts. Here, oscillators 144 and 146 are selected to have frequencies that are not harmonically related. Hence, they may be mixed together through summing resistors 148, 150, and gain setting resistor 152 and then amplified by operational amplifier 154. The mixed signal 143 containing both the fire and hit status of opponent 10 is then presented to transmitter 66 for broadcast to receiver 74. Of course, encoder and enabler 64 also functions in this described manner.

The broadcast signals 156 and 158 are thus modulated waves on different FM carriers having the potential of two distinct modulations corresponding to the fire and hit status of a respective station. It should be appreciated, then, that there are actually two broadcast signals, one signal 156 coming from radio tansmitter 66 and the other signal 158 coming from radio transmitter 68 in electronics module 20, with this second broadcast signal being broadcast from antenna 72 as is shown in FIG. 2. The signal broadcast from the transmitter 68 also may include either or both data corresponding to the firing and hitting states of second gun 16 and second target 18.

It can now be more readily appreciated, with respect to FIG. 2, antennas 28 and 30 each respectively receive the encoded, mixed signals from antennas 70 and 72 and present these signals respectively to first radio receiver 74 and second radio receiver 78. The signal from first radio receiver 78 is passed to decoder and processor 78 where the signal is separated into two component signals, a first fire component signal 160 and a first hit component signal 162. That is, decoder and processor 78 decodes the encoding placed on the signal by encoder and enabler 62 so that the two signals are again separated into distinct components having "fire" status data and "hit" status data. Likewise, second radio receiver 76 presents a mixed signal from second radio transmitter 68 to decoder and processor 80. Decoder and processor 80 decodes the signals from encoder 64 so that the encoded signal is translated into two distinct component signals, a second fire component signal 164 and a second hit component signal 166. These four component signals are presented to logic and interlock circuits 82 which are shown in greater detail in FIG. 6.

As is shown in FIG. 6, the two hit component signals 162 and 166 are processed so that only that hit signal which reaches logic and interlock circuit 82 first in time is outputed to create audio and visual effects corresponding to a hit being registered at one of the stations. To this end it should also be understood that fire component signals 160 and 164 are both passed through logic and interlock circuit 82 and audio and visual output may be produced each time that either gun 14 or gun 16 is fired.

As noted, though, the first received hit component signal prevents or latches the other hit component signal, and this is accomplished by the use of two "555" timers, with timer 170 corresponding to hit component 161 and timer 172 corresponding to hit component 166. Accordingly, hit component 162 passes through an inverter 174 so that a voltage is applied to input n of timer 170. A hit effects signal is then produced at output r of timer 170 and passes to first audio effects 36 and first visual effects 32. The hit effects signal also is presented to an inverter 176 which creates a voltage change on input p of timer 172. This voltage change at input p of timer 172 operates to "inhibit" timer 172 so that signal 166 is latched.

Likewise, where hit component 166 is first received by logic and interlock 82, it is passed through an inverter 178 and is presented to input n of timer 172. Timer 172 generates a hit effects signal at output r which operates second audio effects 38 and second visual effects 34. The hit effects signal of timer 172 also is presented to an inverter 180 which operates to change the voltage at input p of timer 170 which disables timer 170 from passing hit component 162. Associated capacitors and resistors are shown in FIG. 6, and it should be understood that the values and interconnections of these with timers 170 and 172 would be readily apparent and available to one ordinarily skilled in the art. Reset circuitry may also be used to reset logic and interlock circuit 82.

It should also be appreciated by one ordinarily skilled in the art from the foregoing description that various standard electronics are used to process the signals according to the preferred embodiment of the present invention, and that the novelty of the present invention resides in the combination of these subcircuits into a novel fire and hit indicator apparatus and a new method for processing simulataneous fire and hit data. While various devices may be incorporated into this circuitry shown in FIGS. 2–6, specific features have been found by the inventors to be more preferable in this arrangement.

First, it is preferable that the bullet signal and the fire signal from a specific gun or firing device 14 or 16 be different from one another. While the two bullet signals may be modulated differently from one another and while the two firing signals may be modulated differently from one another, it is acceptable for a given system, such as shown in FIG. 2, for both bullet signals to be at the same frequency and both trigger-active fire signals to be at the same frequency. In the preferred embodiment, as is shown in FIG. 3, is it preferred that oscillator and driver 100 present a pulse which is modulated at approximately 10,000 Hz which modulation is directly passed to the bullet signal generator so that bullet signal 13 and correspondingly, bullet signal 15, are pulses modulated at 10,000 Hz. The pulse from oscillator and driver 100 is passed through a frequency divider 104, which in the preferred embodiment, divides the frequency by a factor of four so that the pulse emitted from frequency divider 104 is a pulse modulated at approximately 2500 Hz. This modulated pulse then is presented to the trigger signal generator 106 so that trigger signal 54, and correspondingly, trigger signal 56, are modulated at a frequency of 2500 Hz.

In this manner, then, a bullet signal will not activate the trigger signal sensor, and the trigger-active signal will not activate a bullet signal sensor as a result of the filtering and phase-locked loops provided in the detection circuitry for each of these signals. Further, since the trigger signal is a more omni-directional signal than are the focused, bullet signals, a particular trigger signal coming from one firing device is not strong enough to activate the trigger signal sensor on the opponent's belt electronics. Thus, the trigger signals are more localized signals for localized detection. It should be appreciated, though, that stronger trigger signals could be used and the trigger signals modulated differently from each other so that no unwanted interference or cross talk would be present. Also, by providing the filters and phase-locked loops so that the devices only respond to the modulated signals, there is little likelihood for interference from ambient signals coming from sources alien to the simulated hit and fire apparatus.

In the preferred embodiment, the bullet signal and the trigger signals are produced by infrared light emitting devices, although it should be apprecited that other signalling devices could be used as well. Preferably, signal generators as bullet signal generator 102 and the trigger-active signal generators, such as signal generator 106, are light emitting diodes emitting infrared light at a frequency of 8900 Å, and it should be appreciated that the modulations of this signal are modulations not to the wave length of the infrared source but rather modulations or rapid voltage differentials within a pulse burst. Correspondingly, then, the trigger signal sensors 50, 52 and the bullet signal sensors such as sensor 100 are phototransistors that are operative to respond to the frequency of the modulated pulse bursts of infrared light from the infrared sources. Should other signalling devices be used, it should be understood that compatible detectors be used as the trigger signal sensors and the bullet signal sensors. Phototransistors, however, have been found to be extremely useful in this configuration since they are responsive to low-level thresholds of detection.

It should thus be appreciated from the foregoing that the present invention and apparatus contemplates a method for processing signal data to provide a simulated fire and hit. Thus, the method according to the preferred embodiment of the present invention broadly includes the steps of generating a first trigger-active signal and a first bullet signal at a first source and a second trigger-active signal and a second bullet signal at a second source. The method includes a second step of generating a hit signal whenever a target device is activated by being struck by a bullet signal. Output is produced in response to each generated trigger-active signal, and output is produced which output indicates the presence of a hit signal generated by the target device that is first activated while output corresponding to a later activated target device is prohibited. modulating the trigger-active and bullet signals, preferably at different frequencies. The method also contemplates producing a uniform fire signal from each trigger-active signal regardless of the period that the trigger-active signal is detected, and the method includes producing a uniform hit signal regardless of the period that the bullet signal is detected. In both cases, though, it is understood that detection of each signal must last for at least a minimum selected threshhold duration.

While the present invention has been described with some degree of particularity, it should be appreciated that the present invention is defined by the following claims construed in light of the prior art so that modifications or changes may be made to the preferred embodiment of the present invention without departing from the inventive concepts contained herein.

We claim:

1. A simulated fire and hit indicator apparatus, comprising:

first and second bullet signal sources operative to generate first and second bullet signals respectively;

a first trigger signal source operative to generate a first trigger-active signal at a first frequency;

a second trigger signal source operative to generate a second trigger-active signal at a second frequency different from said first frequency;

a first trigger means for simultaneously activating said first bullet signal source and said first trigger signal source;

a second trigger means for simultaneously activating said second bullet signal source and said second trigger signal source;

first output means responsive to said first and second trigger-active signals for producing first output indicative of the condition of said first and second triggers; and processing means responsive to said first and second bullet signals for processing said bullet signals and producing hit output indicative of the earlier received one of said first and second bullet signals.

2. A simulated fire and hit indicator apparatus according to claim 1 wherein said first and second bullet signal sources each includes bullet signal modulating means for modulating its respective signal.

3. A simulated fire and hit indicator apparatus according to claim 1 wherein said first and second bullet signal sources each includes a multivibrator means for forming its respective bullet signal as pulse burst upon activation of its associated trigger means.

4. A simulated fire and hit indicator apparatus according to claim 1 wherein said first and second trigger active signal sources each includes multivibrator means for forming its respective trigger signal as a pulse burst upon activation of its associated trigger means.

5. A simulated fire and hit indicator apparatus according to claim 1 including first activation circuit for said first bullet signal and said first trigger-active signal and second activation circuit for said second bullet signal and said second trigger-active signal, each of said first and second activation circuits having a one-shot multivibrator operative to produce a voltage pulse burst upon activation of an associated said trigger means, an oscillator operative to modulate said pulse burst and a frequency divider operative to change the modulation frequency of a portion of said pulse burst.

6. A simulated fire and hit indicator apparatus comprising:

a first firing device having a first trigger switch and including first means for generating a first trigger-active signal and a first bullet signal upon initiation of said first trigger switch;

a second firing device having a second trigger switch and including second means for generating a second trigger-active signal and a second bullet signal upon initiation of said second trigger switch;

a first target device including a first detector means for detecting said second bullet signal and for generating a first hit signal in response to the detection of said second bullet signal;

a second target device including a second detector means for detecting said first bullet signal and for generating a second hit signal in response to the detection of said first bullet signal; and signal processing means responsive to said first and second trigger-active signals for generating first and second output indicating activation of said first and second trigger-active signals, respectively, and responsive to said first and second hit signals for generating third output corresponding to one of said first and second hit signals, said signal processing means including discrimination circuitry operative to pass the earlier received hit signal and to exclude the later received hit signal whereby said third output indicates which one of said first and second hit signals was first received by said hit signal processing means.

7. A simulated fire and hit indicator apparatus according to claim 6 wherein said signal processing means includes a first sensor means for sensing said first trigger-active signal and for generating a first fire signal and a second sensor means for sensing said second trigger-active signal and for generating a second fire signal.

8. A simulated fire and hit indicator apparatus according to claim 7 wherein said first sensor means includes a first fire signal pulse processor and stretcher means for generating said first fire signal as a first enhanced, uniform voltage pulse burst, and said second sensor means includes a second fire signal pulse processor and stretcher means for generating said second fire signal as a second enhanced, uniform voltage pulse burst.

9. A simulated fire and hit indicator apparatus according to claim 7 including first encoding means for receiving and mixing said first fire signal and said first hit signal together to form a first combined signal and including a second encoding means for receiving and mixing said second fire signal and said second hit signal together to form a second combined signal.

10. A simulated fire and hit indicator apparatus according to claim 9 wherein said signal processing means including a first receiver means for receiving said first combined signal and first decoder means for separating said first combined signal into a first fire component signal and first hit component signal and including a second receiver means for receiving said second combined signal and second decoder means for separating said second combined signal into a second fire component signal and a second hit component signal, said discrimination circuitry being responsive to said first and second hit component signals and operative to pass the earlier received hit component signal and to exclude the later received hit component signal for generating said third output.

11. A simulated fire and hit indicator apparatus according to claim 10 including a first radio transmitter operative to receive said first combined signal and transmit a first radio signal modulated according to said first combined signal, said first receiver means being a radio receiver tuned to said first radio transmitter whereby said first receiver means receives said first combined signal by way of said first radio signal, and including a second radio transmitter operative to receive said second combined signal and transmit a second radio signal modulated according to said second combined signal, said second receiver means being a radio receiver tuned to said second radio transmitter whereby said second receiver means receives said second combined signal by way of said second radio signal.

12. A simulated fire and hit indicator apparatus according to claim 11 including first enabling means for activating said first radio transmitter when either a first fire signal or a first hit signal is present and including second enabling means for activating said second radio transmitter when either a second fire signal or a second hit signal is present.

13. A simulated fire and hit indicator apparatus according to claim 10 wherein said first and second output includes audio output.

14. A simulated fire and hit indicator apparatus according to claim 10 wherein said third output includes audio ouput.

15. A simulated fire and hit indicator apparatus according to claim 10 including a visible display operative to display said third output.

16. A simulated fire and hit indicator apparatus according to claim 6 wherein said first means includes a first power supply and a first multivibrator means for producing a first voltage pulse burst, and said second means includes a second power supply and a second multivibrator means for producing a second voltage pulse burst.

17. A simulated fire and hit indicator apparatus according to claim 16 wherein said first means includes a first oscillator operative to modulate said first voltage pulse burst at a first frequency whereby said first bullet signal and said said first trigger-active signals are modulated pulse bursts, and said second means includes a second oscillator operative to modulate said second voltage pulse burst at a second frequency, whereby said second bullet signal and said second trigger-active signal are modulated pulse bursts.

18. A simulated fire and hit indicator apparatus according to claim 17 including a first frequency divider associated with said first oscillator whereby said first bullet signal is modulated at a frequency different from said first trigger-active signal, and including a second frequency divider associated with said second oscillator whereby said second bullet signal is modulated at a frequency different from said second trigger-active signal.

19. A simulated fire and hit indicator apparatus according to claim 16 wherein said first detector means includes first pulse processor and stretcher means for generating said first hit signal as a first enhanced, uniform pulse burst, and wherein said second detector means includes second pulse processor and stretcher means for generating said second hit signal as a second enhanced, uniform pulse burst.

20. A simulated fire and hit indicator apparatus, comprising:

a firing device having a trigger switch and operative to generate a bullet signal and a trigger-active signal upon activation of said trigger switch;

a target device having bullet signal sensor circuitry;

a trigger sensor device having trigger-active signal sensor circuitry;

said trigger signal sensor circuitry having a trigger signal sensor and operative to generate a fire signal in response to receipt of said trigger signal;

said bullet signal sensor circuitry having a bullet signal sensor and operative to generate a hit signal in response to receipt of said bullet signal;

encoding circuitry receiving said fire signal and said hit signal and operative to generate an encoded signal having data indicative of the conditions of at least one of said trigger signal sensor and said bullet signal sensor;

encoded signal response circuitry responsive to said encoded signal and operative to decode said encoded signal into a fire component signal and a hit component signal; and processing means for receiving said fire component signal and said hit component signal and for generating first trigger output indicative of the condition of said trigger signal sensor and hit output indicative of the condition of said hit signal sensor.

21. A simulated fire and hit indicator apparatus according to claim 20 including a first transmitter means for transmitting said first encoded signal, said first encoded signal response circuitry including receiver means for receiving transmitted encoded signal.

22. A simulated fire and hit indicator apparatus according to claim 20 including oscillating means associated with said firing device for oscillating said bullet signal.

23. A simulated fire and hit indicator apparatus according to claim 22 wherein said oscillating means oscillates said trigger-active signal.

24. A simulated fire and hit indicator apparatus according to claim 23 including frequency divider circuitry in said oscillating means for oscillating said bullet and trigger signals at different frequencies.

25. A simulated fire and hit indicator apparatus according to claim 20 including a multi-vibrator means associated with said firing device for generating said trigger signal and said bullet signal as a discrete pulse burst.

26. The method of simulating a gun duel between two opponents each having a gun device with a trigger and a target device, comprising the steps of:

generating a first trigger-active signal and a first bullet signal by activation of the trigger of a first gun device correspondng to a first opponent;

generating a second trigger-active signal and a second bullet signal by activation of the trigger of a second gun device corresponding to a second opponent;

generating a hit signal whenever a target device is activated by being struck by a bullet signal;

producing output indicating the existence of each trigger-active signal when each is respectively generated; and producing output indicating the existence of a hit signal generated by the target device that is first activated while prohibiting the production of output indicating the existence of a hit signal generated by the target device that is subsequently activated.

27. The method of simulating a gun duel according to claim 26 including the step of generating said first and second trigger-active signals and said first and second bullet signals as voltage pulse bursts.

28. The method of simulating a gun duel according to claim 27 including the step of modulating said first and second trigger-active signals and said first and second bullet signals.

29. The method of simulating a gun duel according to claim 28 wherein the modulation of each trigger-active signal occurs at a frequency different from its respective bullet signal.

30. The method of simulating a gun duel according to claim 27 including the step of producing an enhanced fire signal as a uniform pulse burst in response to detection of a threshhold duration of each trigger-active signal.

31. The method of simulating a gun duel according to claim 27 including the step of producing an enhanced hit signal as a uniform pulse burst in response to detection of a threshhold duration of each hit signal.

* * * * *